US006733625B2

(12) United States Patent
Henricson et al.

(10) Patent No.: US 6,733,625 B2
(45) Date of Patent: May 11, 2004

(54) METHOD AND APPARATUS FOR TREATING PULP

(75) Inventors: Kaj Henricson, Helsinki (FI); Eero Kontturi, Espoo (FI); Olavi Pikka, Karhula (FI); Janne Vehmaa, Huutjärvi (FI)

(73) Assignee: Andritz Oy, Helsinki (FI)

( * ) Notice: Subject to any disclaimer, the term of this patent is extended or adjusted under 35 U.S.C. 154(b) by 0 days.

(21) Appl. No.: 09/855,022

(22) Filed: May 15, 2001

(65) Prior Publication Data

US 2002/0088567 A1 Jul. 11, 2002

(30) Foreign Application Priority Data

May 16, 2000 (FI) ..... 2000 1169

(51) Int. Cl.[7] ..... D21C 9/02

(52) U.S. Cl. ..... 162/60; 162/65; 162/70; 162/75; 162/242

(58) Field of Search ..... 162/14–19, 29, 162/30.1, 30.11, 37, 38, 41, 42, 45, 48, 60, 65, 72, 78, 76, 70

(56) References Cited

U.S. PATENT DOCUMENTS

| | | | | |
|---|---|---|---|---|
| 4,042,452 A | * | 8/1977 | Arhippainen et al. | 162/60 |
| 4,297,164 A | * | 10/1981 | Lee | 162/60 |
| 4,810,328 A | * | 3/1989 | Freis et al. | 162/60 |
| 4,956,048 A | * | 9/1990 | Hise | 162/60 |
| 5,217,575 A | | 6/1993 | Backlund | |
| 5,246,543 A | * | 9/1993 | Meier et al. | 162/65 |
| 5,310,460 A | * | 5/1994 | Pelton et al. | 162/60 |
| 5,360,514 A | | 11/1994 | Henricson et al. | |
| 5,429,717 A | * | 7/1995 | Bokstrom et al. | 162/60 |
| 5,783,037 A | * | 7/1998 | Brahmbhatt | 162/237 |
| 5,853,535 A | * | 12/1998 | Maples et al. | 162/30.1 |
| 6,106,667 A | | 8/2000 | Henricson | |

FOREIGN PATENT DOCUMENTS

| | | |
|---|---|---|
| CA | 2132056 | 11/1994 |
| CA | 2170553 | 11/1996 |
| EP | 0 564 443 | 10/1993 |
| WO | WO 97/15715 | 5/1997 |
| WO | WO 98/29598 | 7/1998 |

OTHER PUBLICATIONS

Smook, G. A.; Handbook for Pulp and Paper Technologists, pp. 134, 175–177 (1992).*

Marcucci, Brian J. and Cammarata, Don M.; "Selecting Method of Oxygen Supply Requires Evaluation of Mill Needs", Bleaching Technology, pp. 80–82 (1991).*

Smook, G. A.; Handbook for Pulp and Paper Technologists, pp. 134, 175–177 (1992).*

Marcucci, Brian J. and Cammarata, Don M.; "Selecting Method of Oxygen Supply Requires Evaluation of Mill Needs", Bleaching Technology, pp. 80–82 (1991).*

* cited by examiner

*Primary Examiner*—Peter Chin
*Assistant Examiner*—Eric Hug
(74) *Attorney, Agent, or Firm*—Nixon & Vanderhye P.C.

(57) ABSTRACT

The present invention relates to a method of treating chemical pulp in order to optimize the consumption of bleaching chemicals and to improve the quality of the pulp. Especially the invention relates to a method according to which filtrate obtained from a suitable stage of the washing of brown stock preferably cooked by an alkaline cooking method is treated with an oxidizing chemical prior to the oxygen stage following the brown stock washing.

25 Claims, 2 Drawing Sheets

METHOD AND APPARATUS FOR TREATING PULP

FIELD OF INVENTION

The present invention relates to a method of and apparatus for treating chemical pulp to optimize the consumption of bleaching chemicals and improve the quality of the pulp. Especially the invention relates to a method and an apparatus, by means of which filtrate obtained from a suitable washing stage of brown stock preferably produced by an alkaline cooking process is treated with an oxidizing chemical prior to the oxygen stage following brown stock washing.

BACKGROUND AND SUMMARY OF INVENTION

In the oxygen stage carried out in medium consistency range, the amount of filtrate per one kg of pulp is 6–9 kg, and thus the properties of the filtrate have an essential effect on reactions which the pulp is subjected to in the oxygen stage, as also in the bleaching later on. So, the properties of the filtrate surrounding the pulp may have a significant effect on the chemical treatments carried out on pulp and also the disadvantageous reactions that the pulp is exposed to.

During the cooking, great amounts of organic material, mainly comprising lignin and carbohydrates originating from hemicellulose are detached off the wood fibers. Each of these organic materials has a chemical composition of its own as a result of the cooking conditions. When passing to the washing and the oxygen stage, these organic materials are carrying chemical compounds and end groups, which react with e.g. oxygen and peroxide. Thus, compounds practically inert in cooking conditions are reactive in new chemical conditions.

In most cases the oxygen stage is connected according the counter-current washing principle so that the object of the so-called brown stock washing located between the cook and the oxygen stage is to replace the liquor passed from the cook with the pulp. This liquor may be referred to e.g. washing loss and/or COD-load and is obtained as filtrate from said last washing stage, with filtrate obtained from the washing in the oxygen stage. The latter filtrate has passed through the oxygen stage with the pulp and due to that has an almost insignificant chemical potential to react with the chemicals in the oxygen stage, so that the chemicals may be used specifically for the desired reactions with the pulp. Nevertheless, some amount of black liquor components is always passed through the washing, which components play a different role than the oxidized filtrate.

In this connection, the oxygen stage refers to an alkaline stage carried out pressurized in the pressure range of 1–17 bar (abg.), and pH-range of 8.5–14, in which stage oxygen is present around the fibers at least part of the reaction time. The oxygen stage may have one, two or even more steps, whereby each reaction step comprises a reaction vessel or reaction retention effected with a tube. In practice, reaction step refers in this connection to adding and mixing some chemical used in the oxygen stage and the following retention at the tube portion. A reaction time short when practiced may thus in mathematical modeling lead to oxygen stages having four or even five steps. Reaction retentions are, depending on the applied method, from 0.1 min to 120 minutes, as the reaction retention is dependent on the desired type of reaction. In this connection, the oxygen stage is identified by a washing stage both prior to and after the oxygen stage and the fact that from the filtrate obtained from the washing after the oxygen stage usually at least part or all the filtrate is introduced to the washing prior to the oxygen stage to be used as washing liquid, so that the oxygen stage is connected countercurrently either completely or at least partially.

Most usually, oxygen and alkali and possibly some inhibitor preventing the deteriorating effect of metals on fibers is dosed into the oxygen stage, or the metals traveling with the fibers are otherwise removed or made non-reactive. The alkali charge is usually 1–60 kg ADMT (air dried metric ton) pulp and the oxygen charge 1–50 kg/ADMT pulp. The alkali that is used is most often sodium hydroxide or oxidized white liquor, but in principle all alkaline compounds containing OH-ion are alkalis which might be used in some conditions in the oxygen stage. The oxygen is dosed in gaseous form, the oxygen content most usually being 75–100% of the specific weight. The temperature in the oxygen stage is 70–120° C. and in most cases 80–105° C. The temperature may be raised utilizing some suitable steam having a pressure of 0.5–20 bar and hot water either via washing or dilution. The steam may be used for heating either mixed directly into the pulp or indirectly.

As to reaction kinetics, the oxygen stage is carried out so that raising the temperature and increasing the alkali charge lead to acceleration of the delignification reaction. The oxygen charge, in turn, is mainly not effected without increasing the amount of alkali. The suppliers of the oxygen stage have their own opinions about which variable is determinant in different steps and thus each supplier regulates the chemical and temperature profile according to his own desire. Nevertheless, as to reaction kinetics, in all applications the kinetics of temperature, oxygen and alkali follow one and the same basic principle.

According to our studies, the chemical reactions of the oxygen stage as a whole proceed essentially so that part of the oxygen reacts directly with the lignin compounds of the pulp and splits lignin by means of a direct reaction. Oxygen in itself is a selective chemical, which does not split carbohydrates. But in alkaline conditions part of the oxygen converts to peroxide which is very quickly decomposed to hydroxyl radicals by the effect of e.g. black liquor compounds originating from the cook. A hydroxyl radical is chemically very reactive, and the reactions thereof are not districted to reacting with lignin only, but it also causes splitting of carbohydrate chains of the pulp. Practice has shown that the selectivity or non-selectivity of a hydroxyl radical may be described e.g. so that a hydroxyl radical splits one cellulose molecule per five lignin molecules. In our experiments especially the presence of black liquor increased the degradation of peroxide and, accordingly, accelerated the forming of hydroxyl radicals at the end of the reaction chain, whereby a bigger portion of the oxygen changes via peroxide to hydroxyl radicals and thus causes damages to the pulp.

When elaborating the oxygen delignification following the washing of chemical pulp, the operation of the brown stock washing line, located in the process order prior to the oxygen stage, is usually determined so that the washing losses have to be adequately low before the oxygen stage in order to obtain a satisfactory selectivity. The term washing loss is used to refer to impurities remaining in the pulp despite the washing, which impurities in this case comprise both different chemicals and organic materials dissolved in the liquid phase during the cook. Various producers of apparatuses have different opinions on an acceptable level of washing losses. Nevertheless, prior art has not earlier performed any systematic reporting about any chemical mechanism or reason to why different washing loss levels have in different mills resulted in contradictory results concerning the effect of the impurity of the pulp on e.g. viscosity and strength properties of the pulp. This invention is based on extensive comparative studies, in which at least one significant reason for the quality losses of pulp has been determined and thus chemical reasons for quality losses of pulp found. According to said studies, the quality losses of pulp are generated as a result of the following kind of process:

The conditions in the oxygen stage generate peroxide as oxygen decomposes in alkaline condition.

Peroxide decomposes to hydroxyl radicals.

The presence of non-oxidized black liquor originating from the cook catalyses and accelerates the forming of hydroxyl radicals.

The hydroxyl radicals, due to their low selectivity, split cellulose molecules and thus cause quality losses.

In mills especially the washing loss level varies, whereby black liquor entering the oxygen stage in form of washing losses causes fluctuations in the quality.

In our studies we have noted that if the filtrate surrounding the fiber is oxidized e.g. so that it has been separately oxidized prior to feeding it into the pulp in such a way that as much as possible of the liquor around the fibers is oxidized the strong catalytic effect of black liquor originating from the cook is eliminated at the same. When as much of the liquor in the pulp has been oxidized, the quality of the pulp remains higher. Especially after 20–30 minutes the delignification proceeds selectively, even though the advantage of selectivity may be noticed right in the beginning of this stage, so that the oxygen stage may in every case be utilized in more efficient conditions than in cases where the cook-originating catalyte is present.

Prior art knows a plurality of various applications treating the filtrates of the pulp manufacturing process with an oxidizing chemical. In the methods of prior art, presented e.g. in patent publications WO-A-99/29599, EP-A-0 564 443 and FI-A-96156, the filtrate obtained from the washing following the oxygen/bleaching stage is treated with an oxidizing chemical, after which the filtrate is used as washing liquid in the wash preceding the oxygen stage. FIG. 1 illustrates as an example of prior art the solution of FI patent application 961856. The basic principle of the method described in said publication is not to prevent organic loading from entering the stage, but to decrease effluents and ensure the level of oxidizing in the circulating liquor.

Most usually prior art methods have aimed at either removing heavy metals from the filtrate obtained from pulp washing by oxidizing in order to prevent said metals from hampering e.g. the peroxide stage, or at the common to close the bleaching system of the pulp mill. Said FI publication concentrates specifically on treating the filtrate of the peroxide stage. It has been noticed that in some cases the brightness of the pulp is adversely effected when the washer following the peroxide stage discharges yellowish filtrate, which then is returned as washing liquid to the washer preceding the peroxide stage. In other words, the impurities causing the yellowish color, especially organic impurities, are recirculated back upstream of the peroxide stage. In the invention presented in said publication reveals that the yellowish color of filtrate/washing liquid may be eliminated, if the filtrate, or more exactly the organic impurities therein, are oxidized prior to returning it as washing liquid back to the washer preceding the peroxide stage. The publication suggests exhaust gas of the ozone bleaching stage to be used for the oxidizing, which exhaust gas typically contains the oxygen acting as carrier gas in the ozone stage and some residual ozone. The method according to this publication is strongly related to TCF-bleaching and participates in eliminating many problems related to TCF-bleaching.

It is our understanding that in industrial solutions, separate treatment of the filtrates of the oxygen stage with a chemical has not been performed, though. There have often been various correlations on the effect of washing losses determined by COD (chemical oxygen consumption) analysis illustrating organic washing loss on the operation of the oxygen stage as well as the quality parameters of the pulp, but the information has often been contradictory to practical results obtained from the industry. Partly this is due to e.g. the fact that it is not possible to determine the composition and origin of an oxygen-consuming material from the results of the COD-analysis.

Thinking back, in many solutions applying a two-step oxygen stage, the reasons stated experimentally in the first stage have lead to the aim of milder delignification properties without, on one hand, exactly knowing which chemical mechanisms that is based on and, on the other hand, what will be the effect of the different origin of filtrates in this wholeness. Only experiments made in the mills have proved the solutions to be right. In practice, this has meant that the black liquor filtrate passed in form of washing loss from the cook into the two-step oxygen stage has first been oxidized around the pulp fibers in conditions moderate in view of temperature so that damages to the fibers have remained as small as possible. Not until after the above presented mild first step has it been possible to arrange the conditions in the second oxygen step so that the pulp may be delignified to a low kappanumber without adverse effect on selectivity.

One observation from the experiments is that the oxygen stage itself also produces organic compounds that have a similar catalytic effect as the cook-originating black liquor, but this chemical fraction may not actually be eliminated because it is generated into the process inside said process itself.

Solutions presented in e.g. the following patent publications represent the above mentioned two-step oxygen stages utilizing the oxidation of residual black liquor:

In the solution according to U.S. Pat. No. 5,217,575 describing a two-step oxygen stage, the required temperature difference between the first and the second step is over 20° C. so that the first step is carried out in a lower temperature, clearly less than 90° C. With this temperature difference, the conditions of the treatment stage are made non-advantageous for the actual oxygen stage, but based on our studies they are well suitable especially for the oxidizing of filtrates. In the modification of the two-step oxygen stage according to SE patent 505141, the oxidizing of filtrates has been solved by keeping the temperature in the first reactor, i.e. the first treatment step, below 90° C. The solution according to FI patent publication 98224 is also aimed at the same goal.

In all these solutions, the aim has been to decrease the catalyzing effect of the cook-originating filtrate on the decomposing of the peroxide compounds by dividing the oxygen stage to two or more steps and thus to improve the quality of the pulp. On the other hand, especially in old mills, installing an oxygen stage in the mill often leads to decreased operation of the brown stock washing department, whereby the amount of cook-originating non-oxidized black liquor entering the oxygen stage is increased. In such case, quality losses caused by the oxygen stage have turned out to be unexpectedly great. In addition to that, the fluctuating running conditions of the brown stock washing department, due to e.g. various bottlenecks of the mill, and disturbances in washing conditions readily lead to increased washing losses and, accordingly, to quality losses of pulp.

That is, all the above presented solutions handling with the oxygen stage utilize the treatment of the washing liquid of the wash preceding the oxygen stage, which washing liquid thus originates from the wash after the oxygen stage, with an oxidizing chemical, or the oxidizing of black liquor filtrate in a two-step oxygen delignification together with the pulp in conditions suitable for the purpose. These solutions have their problems, too, e.g. handling the heat balance. Even without heating, the first reactor of the oxygen stage operates according to the balance at a temperature of over 90° C. and the requirement of a lower temperature of the first reactor results in the necessity of cooling the washing liquid of the washer preceding the oxygen stage. In such a case, the pulp must be heated after the first oxygen step using high-pressure steam. Heat obtained from cooling the washing water is difficult to recover in a form preferable in view of the operational economy of the fiber line. Additionally, the investment expenses and operational expenses of heat exchangers are significant. The arrangement of temperature differences in pulp production also contributes to both the forming of precipitates and the generation of extractive problems.

As the filtrate coming from the washing of the oxygen stage is already oxidized, the treatment thereof does not significantly change the situation anymore. That is why the oxidation should according to our studies be performed before the last washing stage prior to the oxygen stage, e.g. between the last and the last but one washing stages. In this way, pulp is being displaced by filtrate, oxidized in the brown stock washing, due to which the pulp is displaced by oxidized filtrate twice (the first being filtrate led as washing liquid countercurrently from the washer following the oxygen stage and the other filtrate oxidized in the brown stock washing), which results in a significant decrease in the amount of cook-originating non-oxidized liquor. Separate oxidizing of liquor entering with the pulp is actually a modification of the oxygen stage, where separate oxidation of filtrates effects especially the properties of the filtrate travelling with the pulp and enhances the access to the aimed benefits of the two-step oxygen stage. Oxidizing the liquid solution between the washers prevents non-oxidized filtrate from entering the oxygen stage also during disturbances.

Thus, the present invention is based on the idea that filtrate essentially related to brown stock washing and the oxygen stage connected thereto is treated with an oxidizing chemical so that the aim is to shut off the black liquor flow entering with the pulp from the cook as washing loss in such a way that as much as possible of the black liquor flow travelling with the pulp in form of washing loss has been gone through an oxidizing stage prior to entering the oxygen stage.

Our studies have brought to light many new ideas concerning integrating the oxygen stage between the cooking and the washing. It has been noticed that because the pulp is hot after the cooking, typically 75–100° C., and amply of alkali is present around the pulp, the pulp is in those conditions subjected to reaction deteriorating the fibers. No special gas dosing is need for generating these reactions, but e.g. releasing pulp from the cooking to an atmospheric state is enough to cause damages. According to our studies, pulp that had been let to stand in black liquor solution at a temperature of 90° C. in atmospheric state under a cover was significantly deteriorated measured by viscosity, without any dosing of oxygen. Thus, alkali and cook-originating black liquor components in atmospheric state together with the oxygen of air are detrimental, so that the time between the blow of the cook and the oxygen stage should preferably be as short as possible. Accordingly, it is preferable to have directly after the cook e.g. a diffuser or DRUMDISPLACER® washer and that retention in all tanks before the oxygen stage have, especially in normal running situations, been minimized as efficiently as possible. The retention time between the blow and the oxygen stage feed might at its shortest be in the range of 1–15 minutes, by means of modem technology most probably around 10 minutes and when effected by somewhat slower alternatives most usually less than 60 minutes, i.e. in the range of 20–50 minutes. That would allow the removal of cook-originating black liquor with its solid matter as soon as possible from surrounding the fibers and replace it with oxidized filtrate originating from the oxygen stage.

Characterizing features of the present invention are described in more detail in the appended patent claims.

Utilizing the method and apparatus according to the invention, e.g. the following advantages are obtained:

- The amount of black liquor catalyte entering the oxygen reactor is essentially decreased.
- The oxygen stage may be carried out in conditions where the portion of non-oxidized filtrate has been significantly decreased, whereby quality losses are decreases.
- Uniformity of the pulp is increased, as the amount of cook-originating black liquor is reduced.
- The oxygen stage may in some cases be performed in one stage, because different conditions for oxidizing the material entering the oxygen stage as washing losses are not needed anymore.
- The strength of the pulp is increased.

BRIEF DESCRIPTION OF THE DRAWINGS

In the following, the method and apparatus according to the invention are described in more detail with reference to the appended figures, of which

DETAILED DESCRIPTION OF THE INVENTION

Figure 1:
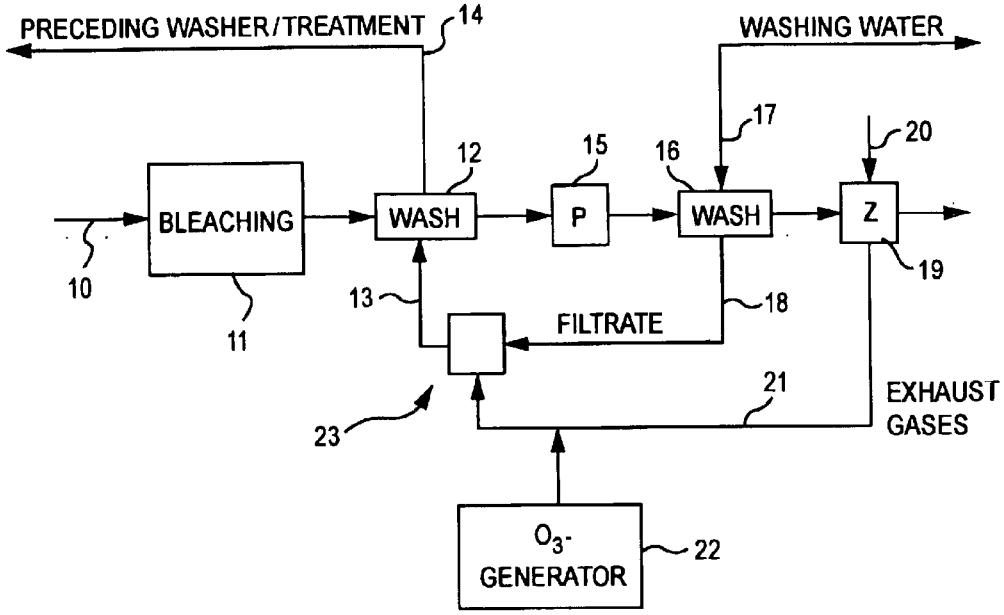
Fig. 1 (Prior Art)
FIG. 1 is a schematic illustration of a prior art method.

FIG. 1 is a schematic illustration of a prior art method of treating/bleaching pulp, which method is more precisely described in FI patent application 961856. The pulp is typically kraft pulp, and the consistency thereof in pipe line 10 is typically about 6–18%. The pulp may alternatively be treated first in one or several first bleaching stage/s 11 typically using chlorine-free bleaching chemical, preferably oxygen, and after that the pulp is washed in a first wash 12, wherein a first washing liquid is fed via feeding conduit 13, and the filtrate is discharged from the wash 12 via pipe line 14. Filtrate flowing in pipe line 14 may be used in earlier washing stages, or it may be treated and used as make-up liquid in other parts of the bleaching plant or pulp mill or treated in other ways.

After the first wash 12, the pulp is led essentially directly into the peroxide bleaching stage 15. Stage 15 may be either atmospheric or pressurized, and the peroxide used therein is typically hydrogen peroxide, the temperature and dosing of which is known or conventional. Typically also, the pulp is of medium consistency when being bleached in stage 15. After stage 15, the pulp is led essentially directly to a second wash 16 provided with a feeding conduit 17 for washing liquid and a discharge conduit 18 for filtrate. The washing liquid fed in conduit 17 may be fresh water or originating from a bleaching stage later in the process. Washes 12 and 16 may be performed utilizing pressing for increasing the consistency and/or they may be performed utilizing any applicable technique, such a displacement wash, drums, pressing and dilution etc.

A second wash 16 may also be connected to all later bleaching stages. In one preferred embodiment of the method of FI application 961856, the ozone stage 19 is located after the wash 16 or prior to the wash 12 (in FIG. 1 after the wash 16). In the ozone stage 19, ozone-containing gas (e.g. oxygen having an ozone content of at least about 8%) is fed into pipe line 20, and typically thoroughly mixed into the pulp, whereby an exhaust gas is generated into pipe line 21. The exhaust gas is typically at a low pressure (e.g. about 2 bar or less), and the content of residual ozone is low (4% or less), typically about 1% or less (normally significantly less than one per cent).

According to said publication, it has been noticed that the feeding of filtrate flowing in pipeline 18 into feeding conduit 13 of the first wash 12 as washing liquid has a disadvantageous effect on the bleaching. The filtrate flowing in pipeline 18 may be typically yellowish, and the yellowish color remains therein up throughout the peroxide stage 15. Normally the exhaust gas of the ozone stage, flowing in pipeline 21, is made to react catalytically in order to remove the ozone, because the passing of residual ozone to the environment is not desirable. The gas flowing in pipeline 21 may also be purified otherwise prior to letting it pass to the environment.

According to said publication, it has further been noticed that the brightness of pulp may be remarkable improved in a bleaching system of FIG. 1 by treating the filtrate flowing in pipe line 18 utilizing a device illustrated in FIG. 1 by reference number 23. In the device 23, the oxidizing gas is put to close contact with the filtrate flowing in pipe line 18, impurities of which filtrate (typically organic material; causing the yellowish color, but other impurities also) are oxidized therewith so that the liquid fed into feeding conduit 13 as washing liquid is relatively pure.

Nevertheless, the above presented as well as other publications concerning the oxygen treatment of filtrates aim at improving the brightness of pulp, closing the bleaching plant and/or optimizing the chemical consumption in the bleaching plant itself. In other words, the treatment is mainly directed to those components in the filtrates, which have been dissolved to the filtrates from the fibers in the bleaching.

Figure 2:
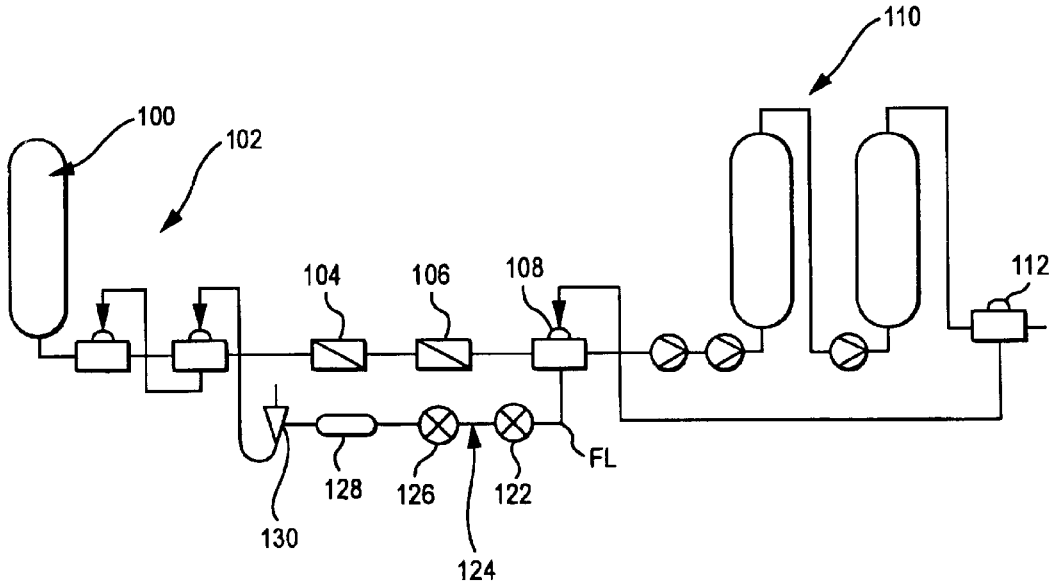
FIG. 2 illustrates a pulp treatment method according to a preferred embodiment of the invention.

FIG. 2 illustrates a pulp production process according to a preferred embodiment of the present invention. It comprises one or more pulp digesters 100, wherefrom the pulp is led directly or via a special blow tank to the brown stock washing plant 102 usually comprising e.g. a one- or multi-stage diffuser, one or more DRUMDISPLACER®—washer/s or several drum washers or presses connected in series. Thus, the washers in this connection are understood to mean all devices based on dilution, thickening or displacement or the combinations thereof and washing is understood to mean methods used in connection therewith. After the washing department 102, the process most often comprises knot screening 104 and screening 106 and a press 108, which is the last washing stage prior to the oxygen bleaching stage 110, which washing stage may be e.g. a drum washer or a press. Further it is worth noticing that what is significant in view of the invention is not the physical implementation of the washing stage, but only the result, which is not dependable on the washing method or apparatus used. In the method according to this embodiment of the invention, the filtrate of the press 108, being the last washing stage prior to the oxygen stage 110, of the screening department 106 located prior to the oxygen stage 110 is used as washing liquid in brown stock washing prior to the oxygen stage 110. The filtrate is most often introduced via a special filtrate tank (not shown), but in suitable conditions a filtrate tank is not inevitable. After the oxygen stage 110, the pulp is washed by means of a washer 112, the filtrate of which is used partially or completely as washing liquid in the wash prior to the oxygen stage 110 according to the principles of countercurrent washing.

All that hag been described in the above is in principle in accordance with prior art. A new solution presented is the treatment of filtrate obtained from the washing device or press 108 prior to the oxygen stage 110 either completely or at least partially in a separate process. According to a preferred embodiment of the invention, said treatment comprises a chemical conduit 124 connected either after the filtrate pump 122 or prior to it into filtrate line FL, in which conduit a required amount of chemical oxidizing the filtrate is dosed into the filtrate, although in our experiments oxygen, hydrogen peroxide or a combination of oxygen and peroxide have proved to be preferable chemicals. Other derivatives of oxygen and peroxide are also just as suitable. Thus, e.g. Caron-acid or peracetic acid is a good alternative. The residual gas containing oxygen and ozone of the ozone stage is also well suitable for oxidizing filtrates. Further, considering the invention in a broader scale, any oxidizing chemical may be considered to be used. In the embodiment of the figure, there is a mixer 126 arranged in the filtrate line FL after the chemical conduit, in which miser the added chemicals are mixed under heavy turbulence. It is, naturally, clear that the chemicals may, if desired, be added also directly into the mixer 126 or pump 122 without a separate chemical conduit 124 arranged in the filtrate line FL. The oxidizing of the organic material in the filtrate, which oxidizing is generated by the chemicals, initiates at the mixing point of the chemical, after which the liquid is taken preferably into a reaction pipe 128, which pipe may in some conditions be just a flow pipe and in which the oxidizing is allowed to proceed during 0.1–60 minutes. When the filtrate is oxidized with oxygen, it is preferable that the temperature during the oxidizing is the same or higher than the temperature of the pulp at the oxygen stage feed. The non-reacted gas is removed from the filtrate by means of a gas-separation device 130 as efficiently as possible prior to leading the filtrate in countercurrent principle to the washer 102. Preferably the washer where the oxidized filtrate is taken to is a washing device preceding the washing/pressing device prior to the oxygen stage, and more preferably the washing device just prior to the washing/pressing device prior to said oxygen stage. The filtrate line FL may further be provided with two consequent pumpings, whereby the liquid after the reaction pipe 128 is released to atmospheric pressure, whereby the separation of gases takes place via a separate tank or pipe.

In addition to the filtrate obtained from said washing device prior to the oxygen stage, it is also possible to, either in addition to the method described in the above or only, take filtrate to be oxidized from another washer between the cooking and the oxygen stage and return said filtrate oxidized preferably countercurrently either to a washing device prior to the point where the filtrate was taken from or to a washing device further in the countercurrent direction.

The gas-separation may be effected by means of several types. As examples, the gas-separation tanks marketed by Andritz-Ahlstrom Oy under trade mark DECULATOR®, the gas-separating pumps marketed by Ahlstrom Pumps Oy under trade marks AIRSEP and ARP, various gas-separation cyclones and e.g. devices of the kind described in U.S. Pat. Nos. 3,203,354, 2,747,514, 2,882,698 and 2,228,816 may be mentioned.

As to the treatment of the gas separated from the oxidized filtrate, according to a preferred embodiment it is effected so that the separated gas or the mixture of the gas and foam simultaneously separated from the process is taken into a filtrate tank, in which the gas is further separated to be used in connection with other gas-treatment in the mill.

Figure 3:
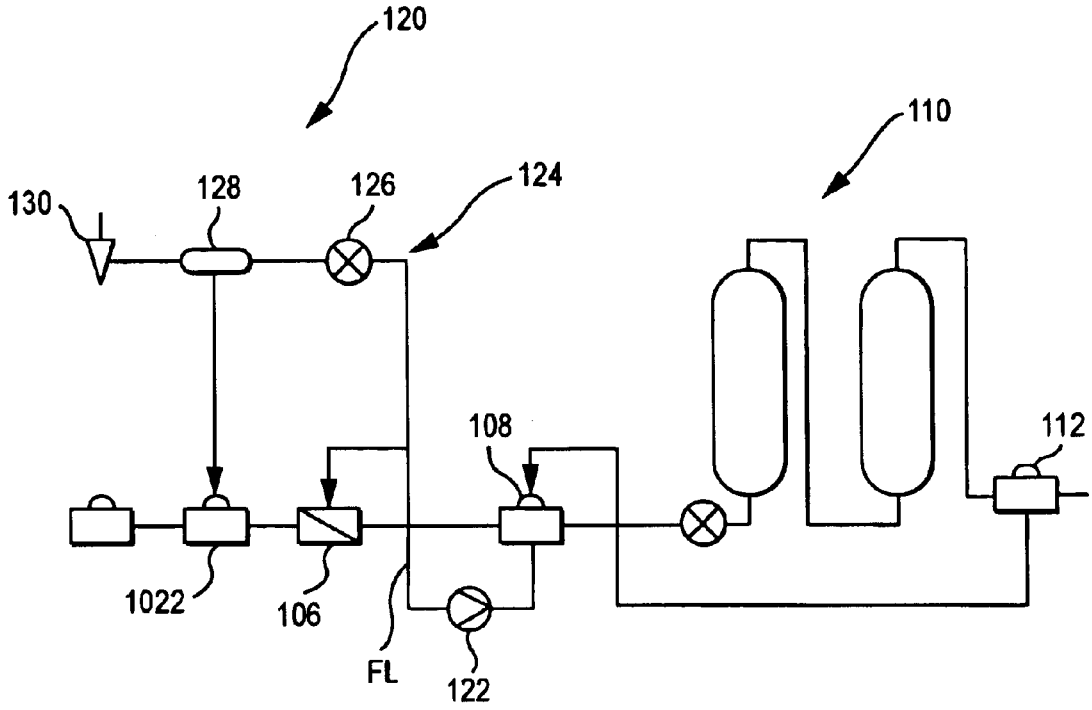
FIG. 3 illustrates a pulp treatment method according to a second preferred embodiment of the invention.

According to a second preferred embodiment of the invention, shown in FIG. 3, the filtrate fraction which is taken to a washer 1022 preceding the washer 108 prior to the oxygen stage to be used therein as washing liquid, is oxidized in a separate oxidizing apparatus 120, while the filtrate which is led to the screening department 106 to be used for dilution is left untreated. With this kind of connection, as little as possible of cook-originating non-oxidized material is introduced to be oxidized, but all the amount of washing water being used in the last but one washer 1022 is oxidized. In other words, by utilizing said solution the consumption of oxidizing chemical may be minimized. The filtrate oxidized in apparatus 120 displaces in the last but one wash 1022 the non-oxidized liquid in the pulp, whereby the pulp will be displacement washed with oxidized filtrate already before the last washing stage 108. After that the pulp enters the last washing stage 108, preceding the oxygen stage, in which washing stage it is displaced by filtrate oxidized in the oxygen stage 110 together with the pulp, said filtrate being obtained from washer 112 following the oxygen stage. Utilizing this kind of arrangement, the cook-originating non-oxidized filtrate is both oxidized and displaced from the pulp as thoroughly as possible.

The pulp is then led to the oxygen stage, where it is treated in e.g. the following conditions: pressure range 1–17 bar (abs.), pH 8.5–14, temperature 70–120° C., most usually 80–105° C., and reaction time from 0.1 minutes up to 120 minutes. The charge of alkali to the oxygen stage is commonly 1–60 kg/ADT pulp and that of oxygen 1–50 kg/ADT pulp. The raising of the temperature may be effected by suitable steam having a pressure of 0.5–20 bar. The oxygen stage may comprise one, two or even more steps as desired. The above described oxygen stage according to the invention is preferably both preceded and followed by a washing stage. Filtrate obtained from the wash after the oxygen stage, at least part thereof or all of it, is usually introduced as washing liquid to the wash preceding the oxygen stage, so that the oxygen stage is connected countercurrently completely or at least partially In the following, some results of one of our test series are presented in form of a table. According to the table, the amount of non-oxidized material in the oxygen stage has essentially decreased.

Table 1 illustrates the amount of cook-originating organic load measured by COD without a separate oxidation during the wash and with a separate oxidation.

TABLE I

| | oxidation | without |
|---|---|---|
| wash. effic. prior to oxidation E10 | 12.5 | |
| wash. effic. after oxidation E10 | 3.5 | |
| wash. effic. total E10 | 16 | 16 |
| COD from oxygen stage | 28 | 28 |
| wash. effic. after oxygen stage E10 | 8 | 8 |
| total COD into oxygen stage kg/adt | 95 | 97 |
| cook-origin. COD, kg/adt | 5.5 | 23.2 |
| dilution factor t/admt | 2.5 | 2.5 |

Observing the results in the table, it is noticed that with separate oxidation of the filtrates it is possible, depending on the washing efficiency of the last washer, to signficantly decrease the amount of cook-originating non-oxidized impurities. Even the fact that although the exemplary case without oxidation is chosen so that the washing efficiency is high, the amount of impurities passing to the oxygen stage is remarkable anyway. Separate oxidation of the filtrates before the oxygen stage changed the situation significantly, i.e. cook-originating COD decreased from 23.3 to 5.5 kg/ADT pulp.

According to a third preferred embodiment of the invention, the time between the blow of the cook and the oxygen stage feed is minimized to be less than 60 minutes, preferably 15–50 minutes and most preferably 1–15 minutes. This allows for minimizing the time during which the pulp may be deteriorated under the effect of the oxygen of air, because the oxygen of air and the COD of the cook form radicals that have been seen to deteriorate the pulp. This kind of optimizing is preferable, even if the filtrates were not even oxidized. At the same time, care must be taken to ensure a sufficient washing efficiency in order to obtain a low amount of cook-originating organic material when reaching the oxygen stage. The washing efficiency between the blow of the cook and the oxygen stage shall be more than 3 measured by $E_{10}$, preferably more than 5, most preferably more than 7.

To fulfill the requirement of high washing efficiency between the blow of the cook and the oxygen stage feed, the wash must comprise more than one stage. Because retention in alkaline conditions in the tanks is disadvantageous for the quality of the pulp, it is preferable to effect the multi-stage washing utilizing a single apparatus without intermediate pumping of the pulp and with total retention of the pulp in all washing stages less than 3 minutes, The acceleration of the displacement so that the retention time per one washing stage is less than 1.5 min requires that the pulp is being displaced through a cake having a thickness of less than 90 mm, preferably less than 70 mm. In this case, the impressions "more than one washing stage" or "more than one stage" are used to mean also those partial washing stages, in which e.g. internal circulations of the DRUMDISPLACER®—washing drum have made it possible to generate internal circulation in addition to the dosing of the washing water amount in order to improve the washing efficiency. For instance, in a 1.X-staged washer comprises more than one washing stage, when X is between 1 and 9, said numerals included. Preferably the pulp is introduced from the blow to the washing as soon as possible so that there is no tank retention or it is 1–10 minutes and the pulp is taken to the washing by means of the pressure of the digester or the whole washing is effected utilizing a single pump as described in the above.

Naturally, the washing efficiency and the retention time of the pulp walk hand in hand so that the longer the retention time, the greater the value E10 measuring the washing efficiency should be. To put it differently, when the retention time is in the range of 60 minutes, the washing efficiency should be at least in the range on 10. With a retention time of 15–50 minutes, the washing efficiency should be at least 5, preferably of course greater, even up to ten. If the retention time is very short, i.e. 1–15 minutes, the washing efficiency should even then be at least 3, preferably greater, even up to ten measured by $E_{10}$-value.

A characterizing feature of the method according to a fourth preferred embodiment of the invention is that only a part of the filtrate of a washing apparatus is oxidized and led to a wash preceding the oxygen stage. In such a case, a fractionating wash, which may be effected also by means of a DRUMDISPLACER®—washer, is preferable. It is also clear that in case when the washing apparatus is the above mentioned DRUMDISPLACER®—washer as a multi-stage modification, it is e.g. possible to treat the filtrate obtained from the last stage of said washer by oxidizing it prior to feeding it as washing liquid into the last but one washing stage of said washer.

According to a fifth preferred embodiment of the invention, the filtrate system between the digester and the washing department is arranged with the aim of minimizing or totally preventing the mixing of air into the filtrate. This may be enhanced e.g. by arranging the filtrate tanks of the washing department, at least one of them, to operate under overpressure. In this way it is possible to prevent the oxygen of the air from reacting with the cook-originating COD present in the filtrate.

According to a further preferred embodiment of the invention, the pulp is led from the digester under the pressure of the digester up to the oxygen stage feed pump, whereby the pulp is subjected to as little of strong turbulence capable of deteriorating the fibers as possible. In some cases it would be possible to feed to pulp from the digester into the oxygen stage even without any intermediate pumping stage, but most often it is inevitable to accept the use of mostly one pump between the digester and the oxygen stage.

As seen from the above, a completely new kind of method has been developed for improving and enhancing the operation of the oxygen stage. Utilizing said method, it is possible to both decrease the chemical consumption of the oxygen stage and to essentially improve the quality of the pulp obtained from the oxygen stage. It has to be noted from the above, that the whole description is to be understood as a preferred example of the invention. Thus, it is completely possible that the method according to the invention may be accomplished even in may other ways, which nevertheless fall inside the scope of the invention determined in the appended claims. Accordingly, referring to the wording of the claims, it is totally possible that the oxidation of the filtrates is performed as close to the cooking as possible or even in connection the so-called digester-wash, which also is in the scope of our invention.

What is claimed is:

1. Method of treating chemical pulp comprising at least cooking cellulose fibrous material, washing the cooked pulp in several stages comprising successively at least a first washing stage and a second washing stage, and delignificating/bleaching the washed pulp in an oxygen stage following the washing of the pulp, wherein at least part of the filtrate of the second washing stage preceding the oxygen stage is recycled countercurrently and treated with an oxidizing chemical before said filtrate or part of it is used as washing liquid in the first washing stage in order to decrease or prevent the reactions between the oxygen and some cook-originating organic material in the presence of the pulp, and wherein the chemical to be mixed is gaseous, whereby after a certain retention time said filtrate-chemical mixture is led to gas-separation prior to leading the filtrate to the first washer as washing liquid.

2. Method according to claim 1, wherein at least part of the washing liquid used in the second washing stage is filtrate obtained from the washer following the oxygen stage.

3. Method according to claim 1, wherein the washing preceding the oxygen stage is performed by means of a suction drum filter, a diffuser, a belt washer, a multi-stage drum filter or a press.

4. Method according to claim 1, wherein only a part of the filtrate that is being used as washing liquid in the first stage is treated with an oxidizing chemical.

5. Method according to claim 1, wherein the oxidizing chemical is oxygen or hydrogen peroxide or a derivative thereof.

6. Method according to claim 1, wherein the washing apparatus is a multi-stage drum filter or several drum filters connected in series.

7. Method according to claim 6, wherein said filtrate is obtained from a washing stage of said multi-stage drum filter and treated with an oxidizing chemical before it is returned back to another washing stage of said multi-stage drum filter to be used as washing liquid.

8. Method according to claim 3, wherein the washing apparatus is a combination of said devices or a series connection of a said device.

9. Method according to claim 8, wherein said filtrate is obtained from a filtrate tank of said series connection and returned as washing liquid to a said washing device.

10. Method according to claim 1, wherein said at least part of the filtrate of the second washing device preceding the oxygen stage is led after the washer into chemical mixing, after which the filtrate-chemical mixture is allowed a sufficient retention time after which the oxidized filtrate is led to the first washer as washing liquid.

11. Method according to claim 1, wherein said gas-separation is effected in an open container, wherefrom the filtrate is pumped to the first washer.

12. Method according to claim 1, wherein said gas-separation is effected by means of a discharging device, wherefrom the filtrate is led directly to the first washer as washing liquid.

13. Method of treating chemical pulp comprising at least cooking cellulose fibrous material, washing the cooked pulp in several stages comprising successively at least a first washing stage and a second washing stage, and delignificating/bleaching the washed pulp in an oxygen stage following the washing of the pulp, wherein at least part of the filtrate of the second washing stage preceding the oxygen stage is recycled countercurrently and treated with an oxidizing chemical before said filtrate or part of it is used as washing liquid in the first washing stage in order to decrease or prevent the reactions between the oxygen and some cook-originating organic material in the presence of the pulp, wherein alter the washing effected with oxidized filtrate, the pulp is led to an oxygen stage having a pH more than 7.5, a pressure of 1–17 bar (abs.), a temperature between 75–120° C. and treatment time between 0.5–120 minutes.

14. Method according to claim 13, wherein oxygen in the amount of 1–50 kg/ADT pulp and alkali in the amount of 1–60 kg/ADT pulp is fed into said oxygen stage.

15. Method according to claim 13, wherein said oxygen stage comprises one or several steps, whereby the steps are counted according to the mixing and chemical dosing.

16. Apparatus for treating chemical pulp, which apparatus comprises at least a digester for cellulose fibrous material, brown stock washing devices, devices following the wash of the pulp for delignifying/bleaching the pulp in an oxygen stage and devices for washing the pulp after the oxygen stage and further filtrate lines for leading washing filtrates countercurrently to preceding washers to be used as washing liquid, wherein the filtrate line preceding the oxygen stage is provided with devices for treating the filtrate flowing in that part of the line with oxidizing chemicals wherein when using a gaseous chemical, in the filtrate line after the mixer there is arranged a separator for excess non-reacted gas.

17. Apparatus according to claim 16, wherein said oxidizing devices are arranged in a filtrate line located between the washer just prior to the oxygen stage and the washer preceding said washer.

18. Apparatus according to claim 16, wherein said oxidizing devices comprise at least a mixer.

19. Apparatus according to claim 18, wherein the mixer used is a filtrate pump or a mixer arranged in the filtrate line for that special purpose.

20. Apparatus according to claim 16, wherein the apparatus further comprises after the mixer a reaction vessel or flow pipe, by means of which a sufficient reaction time is effected for the filtrate and the chemical.

21. Apparatus according to claim 16 or 18, wherein said gas-separator is connected to the filtrate tank wherein the separated gas and foam possibly separated with it are led.

22. Apparatus for treating chemical pulp, which apparatus comprises at least a digester for cellulose fibrous material, brown stock washing devices, devices following the wash of the pulp for delignifying/bleaching the pulp in an oxygen stage and devices for washing the pulp after the oxygen stage and further filtrate lines for leading washing filtrates countercurrently to preceding washers to be used as washing liquid, wherein the filtrate line preceding the oxygen stage is provided with for treating the filtrate flowing in that part of the line with oxidizing chemical, and wherein the filtrate system preceding the oxygen stage comprises at least one pressurized reaction vessel.

23. Method of treating chemical pulp comprising at least cooking cellulose fibrous material, washing the cooked pulp in several stages comprising successively at least a first washing stage and a second washing stage, and delignificating/bleaching the washed pulp in an oxygen stage following the washing of the pulp, wherein at least part of the filtrate of the second washing stage preceding the oxygen stage is recycled countercurrently and treated with oxygen and/or hydrogen peroxide before said filtrate or part of it is used as washing liquid in the first washing stage in order to decrease or prevent the reactions between the oxygen and some cook-originating organic material in the presence of the pulp.

24. Method according to claim 23, wherein said at least part of the filtrate of the second washing stage preceding the oxygen stage is treated with one of oxygen or hydrogen peroxide.

25. Method according to claim 23, wherein said at least part of the filtrate of the second washing stage preceding the oxygen stage is treated with a combination of both oxygen and hydrogen peroxide.

* * * * *